US009879492B2

(12) United States Patent
Kitzman

(10) Patent No.: US 9,879,492 B2
(45) Date of Patent: Jan. 30, 2018

(54) DISINTEGRATING EXPAND IN PLACE BARRIER ASSEMBLY

(71) Applicant: Baker Hughes Incorporated, Houston, TX (US)

(72) Inventor: Jeffery D. Kitzman, Spring, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 359 days.

(21) Appl. No.: 14/693,637

(22) Filed: Apr. 22, 2015

(65) Prior Publication Data

US 2016/0312557 A1 Oct. 27, 2016

(51) Int. Cl.

| | |
|---|---|
| ***E21B 23/01*** | (2006.01) |
| ***E21B 43/10*** | (2006.01) |
| ***E21B 29/02*** | (2006.01) |
| ***E21B 43/26*** | (2006.01) |
| ***E21B 23/06*** | (2006.01) |
| ***E21B 33/12*** | (2006.01) |

(52) U.S. Cl.

CPC ..... *E21B 23/01* (2013.01); *E21B 23/06* (2013.01); *E21B 29/02* (2013.01); *E21B 33/1204* (2013.01); *E21B 43/103* (2013.01); *E21B 43/108* (2013.01); *E21B 43/26* (2013.01)

(58) Field of Classification Search

CPC ..... E21B 33/13; E21B 43/261; E21B 43/108; E21B 43/11; E21B 43/26; E21B 43/103; E21B 23/06; E21B 33/1204; E21B 23/01; E21B 29/02

See application file for complete search history.

(56) References Cited

U.S. PATENT DOCUMENTS

| | | | |
|---|---|---|---|
| 2,214,226 | A | 9/1940 | English |
| 2,261,292 | A | 11/1941 | Salnikov |
| 3,216,497 | A | 11/1965 | Howard et al. |
| 5,103,911 | A | 4/1992 | Heijnen |
| 5,273,115 | A | 12/1993 | Spafford |
| 7,451,815 | B2 | 11/2008 | Hailey, Jr. et al. |
| 7,461,699 | B2 | 12/2008 | Richard et al. |
| 7,661,481 | B2 | 2/2010 | Todd et al. |
| 7,762,342 | B2 | 7/2010 | Richard et al. |
| 8,297,364 | B2 | 10/2012 | Agrawal et al. |
| 8,342,240 | B2 | 1/2013 | Richard et al. |
| 8,668,019 | B2 | 3/2014 | Casciaro |
| 8,794,335 | B2 | 8/2014 | Fadul et al. |
| 8,857,513 | B2 | 10/2014 | O'Malley |

(Continued)

*Primary Examiner* — Michael R Wills, III
(74) *Attorney, Agent, or Firm* — Steve Rosenblatt

(57) ABSTRACT

A clad is expanded with a variable swage or other ways to create a seat for an object to obstruct the passage therethrough while at the same time expanding at least a part of the clad into a surrounding tubular for support and sealing. The exterior of the clad can have grit to enhance the grip. A perforating gun can be delivered in the same trip with the clad. After the swage passes through the clad the gun is positioned and fired, the bottom hole assembly is retrieved and the ball is dropped from the surface onto the seat formed in the clad with expansion or with some other means. A treating operation against the clad and into the surrounding formation can then take place. The process can be repeated preferably in a bottom up direction until the formation is fully treated. The clads and objects landed on the clads disintegrate with time or borehole exposure.

17 Claims, 1 Drawing Sheet

(56) References Cited

U.S. PATENT DOCUMENTS

| | | | | |
|---|---|---|---|---|
| 9,010,416 | B2 * | 4/2015 | Xu | E21B 33/129 166/212 |
| 2002/0166668 | A1 * | 11/2002 | Metcalfe | B21D 17/04 166/378 |
| 2011/0136707 | A1 | 6/2011 | Xu et al. | |
| 2012/0152567 | A1 * | 6/2012 | Whiddon | E21B 43/106 166/382 |
| 2013/0000914 | A1 * | 1/2013 | Kelbie | E21B 43/103 166/308.1 |
| 2013/0299185 | A1 | 11/2013 | Xu et al. | |
| 2014/0014339 | A1 | 1/2014 | O'Malley et al. | |
| 2014/0027127 | A1 | 1/2014 | Frazier et al. | |
| 2014/0060830 | A1 * | 3/2014 | Love | E21B 43/103 166/280.1 |
| 2014/0060837 | A1 * | 3/2014 | Love | E21B 43/26 166/297 |
| 2015/0053397 | A1 | 2/2015 | Filyukov et al. | |

* cited by examiner

DISINTEGRATING EXPAND IN PLACE BARRIER ASSEMBLY

FIELD OF THE INVENTION

The field of the invention is barriers that can be positioned in a borehole to aid a treatment involving pressurized fluid and more particularly a barrier that is formed in place from a disintegrating material using a variable diameter swage to create a landing location for an obstructing object in aid of the pressure treatment of a surrounding formation.

BACKGROUND OF THE INVENTION

Well treatments such as fracturing are frequently performed using a series of plugs that have a passage through them that is surrounded by a ball seat. A repeating pattern of setting a plug and releasing from the plug with a perforating gun to fire the gun and then to either remove the gun and drop a ball or to drop a ball while the gun is still in the hole with the final step using pressure against the seated ball in the plug for the treatment of a part of the adjacent formation. Typically a bottom up direction is employed of this pattern as further portions of the surrounding formation are treated. When the entire formation is treated the plugs need to be removed before production or injection begins. This can be done by milling out all the plug which can be time consuming. Parts of the plugs can be made of disintegrating materials but the remaining components still need either to be drilled out, pushed to bottom or circulated out. The plugs themselves are costly to produce and present some inherent risks that they will not properly set. Some jobs require a large number of plugs regardless of whether they are all set initially and then sequentially sealed off with progressively larger balls or are run in and set sequentially.

Also relevant in general to the subject of barriers that disappear or degrade are U.S. Pat. Nos. 8,794,335; 8,668,119; 8,342,240; 8,297,364; 7,661,481; 7,762,342; 7,461,699; 7,451,815; 5,103,911; 3,216,497; 2,261,292; 2,214,226; 20130299185 and 2014/0027127. Of particular significance is 20140014339 FIG. 11 which shows a tool that sets a disintegrating member that comes equipped with a ball seat.

The present invention is a departure from these known techniques in that instead of the plugs it encompasses delivery of a clad with a variable diameter swage to allow in essence the creation of a passage with a surrounding seat to accept an object against which pressure can be held to perform the treating operation. The clad is made of a disintegrating material such as a controlled electrolytic material so that after a time or with exposure to heat or well fluids to name some examples, the clad simply disintegrates. One trip operation can be accomplished with the running in of a bottom hole assembly that has the variable swage and the actuation device to move and build the swage after some expansion but to also support a gun and a ball dropping device so that the multi-diameter expansion can take place and the bottom hole assembly raised further after the swage clears the clad so that the gun can be operated to create perforations. The bottom hole assembly can then be retrieved and the ball dropped to close off the clad so that a treatment operation can then immediately begin into the perforations. This can be repeated as many times as needed to cover the entire interval of the formation. Over time the clads and balls released onto the clads simply disintegrate. Those skilled in the art will appreciate other aspects of the present invention from a review of the detailed description of the preferred embodiment and the associated drawings while recognizing the full scope of the invention is to be determined from the claims.

SUMMARY OF THE INVENTION

A clad is expanded with a variable swage or other ways to create a seat for an object to obstruct the passage therethrough while at the same time expanding at least a part of the clad into a surrounding tubular for support and sealing. The exterior of the clad can have grit to enhance the grip. A perforating gun can be delivered in the same trip with the clad. After the swage passes through the clad the gun is positioned and fired, the bottom hole assembly is retrieved and the ball is dropped from the surface onto the seat formed in the clad with expansion or with some other means. A treating operation against the clad and into the surrounding formation can then take place. The process can be repeated preferably in a bottom up direction until the formation is fully treated. The clads and objects landed on the clads disintegrate with time or borehole exposure.

DETAILED DESCRIPTION OF THE PREFERRED EMBODIMENT

Figure 1:
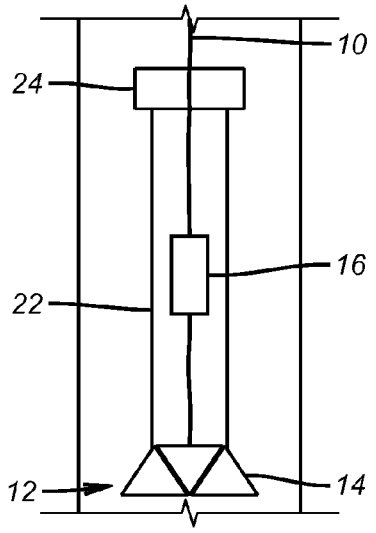
FIG. 1 is a schematic view of the clad being delivered with a bottom hole assembly into a borehole.

Referring to FIG. 1 a wireline or other conveyance 10 supports a bottom hole assembly 12 that comprises a variable swage 14 that supports a perforating gun. Disintegrating ball 20 will ultimately be dropped onto a clad or tubular sleeve 22. For running in the clad 22 is supported on the variable swage 14. Assembly 24 is intended to schematically illustrate bracing for the clad 22 and a setting tool that can selectively advance the swage 14 through the clad 22 and at a predetermined amount of advance by the swage 14 a building of the swage within the clad 22 so that further movement of the swage 14 will reshape the clad 22 to create a ball seat onto which ball 20 can be dropped after the gun 16 is positioned to create perforations 28.

Figure 3:
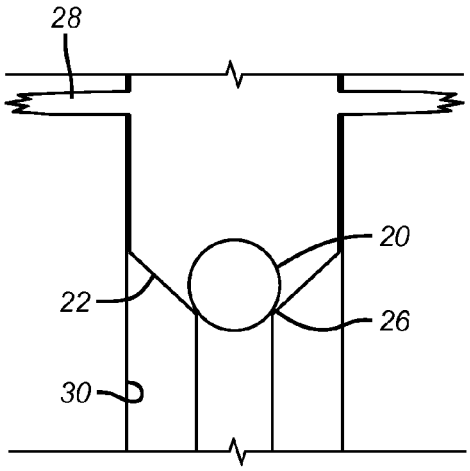
FIG. 3 is the view of FIG. 2 showing the swage removed after fixation of the clad and new perforations made with the perforating gun and the ball dropped onto the clad to facilitate a treatment operation.
Figure 2:
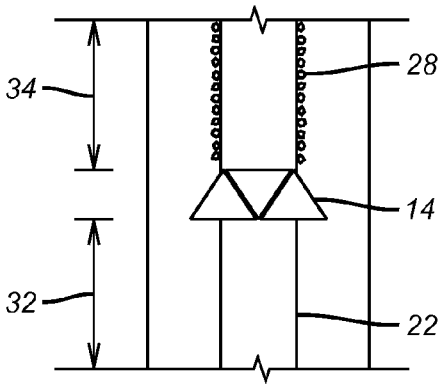
FIG. 2 is the view of FIG. 1 after expansion has started showing the variable swage being built inside the clad to finish the expansion to create a seat around the passage through the clad.

As shown in FIG. 2 the clad 22 has an exterior surface treatment such as a surface roughness or adhered grit or the like 28 to aid in a grip of the surrounding tubular 30 as shown in FIG. 3. FIG. 2 illustrates the swage 14 having been pulled a distance 32 and using the device 24 or communicating to the swage 14 from the wireline 10, the swage is built up to a larger dimension to finish the expansion over distance 34 to then achieve the configuration of FIG. 3. At that time the perforating gun 16 can be repositioned through the now anchored clad 22 and the gun 16 is fired. The remaining bottom hole assembly can be pulled out of hole and the ball 20 dropped from surface. After the ball 20 is seated a treatment using pressure against the seated ball 20 can begin. Treatment methods encompass but are not limited to, hydraulic fracturing, stimulation, tracer injection, cleaning, acidizing, steam injection, water flooding, cementing, etc.

Figure 4:
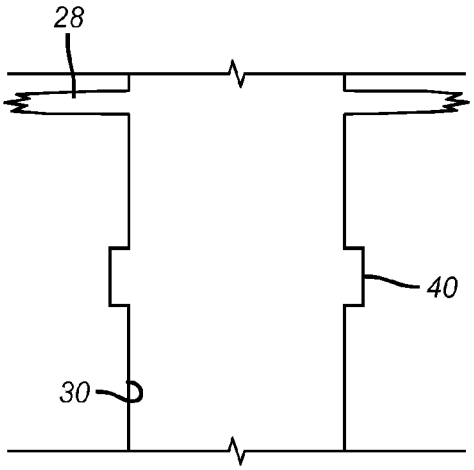
FIG. 4 is the view after disintegration of the clad and the associated ball.

As shown in FIG. 4, the clad 22 and the ball 20 have disintegrated. The clad is preferably made from a known controlled electrolytic material or (CEM). Controlled electrolytic materials have been described in US Publication 2011/0136707 and related applications filed the same day. These applications are incorporated by reference herein as though fully set forth.

While the above described operations have focused on locating a single clad in a borehole combined with perforating and conduction a pressure operation against a seated ball, those skilled in the art will appreciate that the process can be repeated as many times as necessary and preferably in a bottom up direction to fully treat an entire formation in increments. The perforating gun is preferably located above the variable swage. While some initial expansion is preferred in zone 32, the clad 22 can be top supported adjacent device 24 so that as an option there is no expansion of the clad 22 in zone 32 until the point where the variable swage is built within the clad 22 as shown in FIG. 2. The swage can take a variety of forms known in the art to allow it to expand to at least two different diameters. Alternatively, the variable swage 14 can make a gradual smooth transition that looks uphole onto which the ball 20 can land to create a pressure barrier within the surrounding tubular 30. For example the swage can be an array of hydraulically extendable rollers or a variable dimensioned cone that can create the slope for the seat 26 on the way out through the clad 22 when expanding in compression as shown in the Figures. Alternatively the expansion can be done in tension or in the top down direction as opposed to the illustrated bottom up expansion direction while the clad 22 is braced at device 24. The grit 28 can also be an exterior profile texture. Another fixation technique can be providing profiles 40 such as a peripheral recess shown in FIG. 4 on the tubular 30 and using expansion of the clad 22 to engage such profiles for added fixation strength.

Those skilled in the art can appreciate the substantial cost savings from using the described method. The clads 22 are significantly cheaper than the more complex plugs that they replace and the clads 22 and ball 20 are fully disintegrating so as to return the tubular 30 to its original drift dimension after the disintegration and saving the time for any interventions such as for milling non-disintegrating components of plugs that were previously used.

The above description is illustrative of the preferred embodiment and many modifications may be made by those skilled in the art without departing from the invention whose scope is to be determined from the literal and equivalent scope of the claims below:

I claim:

1. A treatment method for a subterranean formation from a borehole, comprising:

delivering at least one sleeve to at least one location in the borehole;

expanding a first portion of the sleeve such that said first portion finds support on a borehole wall while creating a transition between said first and a second portion that defines a seat for an object around a passage through said sleeve;

expanding said second portion from an original dimension to a smaller dimension than said first portion such that said second portion does not engage the borehole directly or indirectly and said sleeve is expanded between opposed ends thereof;

delivering at least one object on said seat to block said passage through said sleeve;

performing a treating operation with pressure on said object on said seat.

2. The method of claim 1, comprising:

providing said sleeve and said object of a disintegrating material;

removing said sleeve and said object after said performing said treating operation.

3. The method of claim 2, comprising:

providing a grip enhancing surface treatment on at least a portion of an outer surface of said sleeve for engagement with the wall of the borehole.

4. The method of claim 2, comprising:

creating said transition with a variable swage.

5. The method of claim 4, comprising:

building said swage within said sleeve for the creation of said transition.

6. The method of claim 2, comprising:

initially supporting said sleeve with a variable swage;

performing said expanding with said sleeve in compression in a bottom up expansion direction.

7. The method of claim 2, comprising:

providing a profile in the borehole wall for support of said sleeve when at least a portion of said sleeve is expanded into said profile.

8. The method of claim 2, comprising:

performing said delivering in a single trip with said sleeve, a swage for said expansion of said sleeve and a perforating gun.

9. The method of claim 8, comprising:

creating said transition with said swage;

repositioning said gun after said creating said transition;

firing said gun to create perforations in the formation;

releasing an object from a surface location after said firing.

10. The method of claim 2, comprising:

providing a plurality of sleeves as said at least one sleeve;

providing a plurality of objects as said at least one object;

sequentially performing said expanding, dropping an object and treating on a first of said sleeves before repeating the pattern on another of said sleeves.

11. The method of claim 10, comprising:

sequentially expanding said sleeves in a bottom up order.

12. The method of claim 2, comprising:

making said treating at least one of hydraulic fracturing, stimulation, tracer injection, cleaning, acidizing, steam injection, water flooding and cementing.

13. The method of claim 2, comprising:

regaining an original drift dimension of the borehole wall after said removing.

14. The method of claim 10, comprising:

regaining an original drift dimension of the borehole wall after said removing.

15. The method of claim 10, comprising:

providing a grip enhancing surface treatment on at least a portion of an outer surface of said sleeves for engagement with the wall of the borehole.

16. The method of claim 15, comprising:

creating said transition with a variable swage.

17. The method of claim 16, comprising:

building said swage within said sleeve for the creation of said transition.

* * * * *